US010240372B2

(12) United States Patent
Dirnberger et al.

(10) Patent No.: US 10,240,372 B2
(45) Date of Patent: Mar. 26, 2019

(54) DOOR LATCH FOR AN ELECTRICAL HOUSEHOLD APPLIANCE, FOR EXAMPLE A WASHING MACHINE

(71) Applicant: emz-Hanauer GmbH & Co. KGaA, Nabburg (DE)

(72) Inventors: Albert Dirnberger, Neunburg v. W. (DE); Dominik Walz, Nabburg (DE)

(73) Assignee: emz-Hanauer GmbH & Co. KGaA, Nabburg (DE)

( * ) Notice: Subject to any disclaimer, the term of this patent is extended or adjusted under 35 U.S.C. 154(b) by 361 days.

(21) Appl. No.: 15/013,262

(22) Filed: Feb. 2, 2016

(65) Prior Publication Data

US 2016/0251881 A1 Sep. 1, 2016

(30) Foreign Application Priority Data

Feb. 27, 2015 (DE) ..... 10 2015 002 538

(51) Int. Cl.

| | |
|---|---|
| ***E05C 3/12*** | (2006.01) |
| ***D06F 37/28*** | (2006.01) |
| ***E05B 47/06*** | (2006.01) |
| ***E05C 19/02*** | (2006.01) |
| ***E05B 65/00*** | (2006.01) |

(Continued)

(52) U.S. Cl.

CPC ..... *E05C 3/12* (2013.01); *D06F 37/28* (2013.01); *E05B 47/0603* (2013.01);

(Continued)

(58) Field of Classification Search

CPC ..... D06F 37/42; D06F 39/14; D06F 37/28; D06F 37/10; A47L 15/4259;

(Continued)

(56) References Cited

U.S. PATENT DOCUMENTS 3,765,194 A 10/1973 Moore
7,032,939 B2 * 4/2006 Magnusson ..... E05B 63/20 292/121

(Continued)

FOREIGN PATENT DOCUMENTS

DE 19837248 A1 2/2000
DE 102010051518 A1 5/2012

(Continued)

OTHER PUBLICATIONS

Polish Patent Office Search Report in co-pending application P-416125, dated Jun. 21, 2016.

*Primary Examiner* — Mark A Williams
(74) *Attorney, Agent, or Firm* — Robert R. Deleault, Esq.; Mesmer & Deleault, PLLC

(57) ABSTRACT

A door latch for an electrical household appliance includes a latch housing in which a gripping unit is received. The door latch further includes a first arresting element which is received in the latch housing such that it is movable between a release position and an arresting position. In the arresting position, the first arresting element blocks the gripping unit to prevent rotation into the open rotational position and, in the release position, permits a rotation of the gripping unit into the open rotational position. A second arresting element is received in the latch housing such that it is movable between an unlocking position and a locking position. In the locking position, the second arresting element effects a blocking of the first arresting element to prevent rotation into the release position, in the unlocking position, the second arresting element permits such a movement of the first arresting element.

12 Claims, 6 Drawing Sheets

(51) Int. Cl.
*D06F 39/14* (2006.01)
*E05C 3/24* (2006.01)

(52) U.S. Cl.
CPC ..... *E05B 65/00* (2013.01); *E05C 19/024* (2013.01); *D06F 39/14* (2013.01); *E05C 3/24* (2013.01)

(58) Field of Classification Search
CPC ..... E05C 19/024; E05C 1/08; E05C 19/12; E05C 3/12; Y10S 292/69; F24C 15/022; E05B 15/0046; E05B 47/0607; E05B 47/0603; Y10T 292/702
USPC ..... 292/195
See application file for complete search history.

(56) References Cited

U.S. PATENT DOCUMENTS 8,083,273 B2 * 12/2011 Yuan ..... E05B 47/0012 292/197
8,646,816 B2 * 2/2014 Dziurdzia ..... E05B 17/0029 292/201
9,107,560 B2 8/2015 Bauriedl
9,657,500 B2 * 5/2017 Min ..... E05B 47/0001
2003/0160461 A1 * 8/2003 Promutico ..... D06F 37/42 292/216
2006/0101869 A1 5/2006 Osvatic
2011/0057460 A1 * 3/2011 Onofrio ..... A47L 15/4259 292/251.5
2012/0119522 A1 * 5/2012 Bauriedl ..... A47L 15/4259 292/228
2016/0138809 A1 * 5/2016 Colucci ..... E05B 63/20 292/122

FOREIGN PATENT DOCUMENTS

JP 2008-274741 A 11/2008
PL 361358 A 10/2004
WO 02/34994 A1 5/2002
WO 2011-132213 A1 10/2011
WO 2013-109585 A2 7/2013

* cited by examiner

Fig. 1 - Prior Art
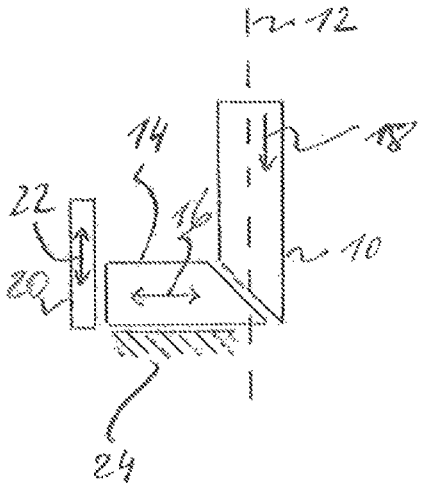
Fig. 2 - Prior Art
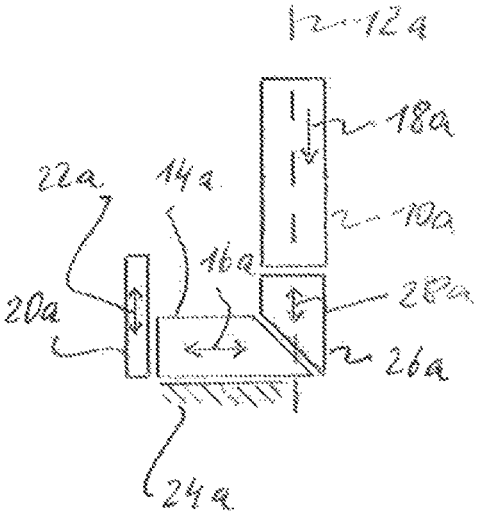
Fig. 3
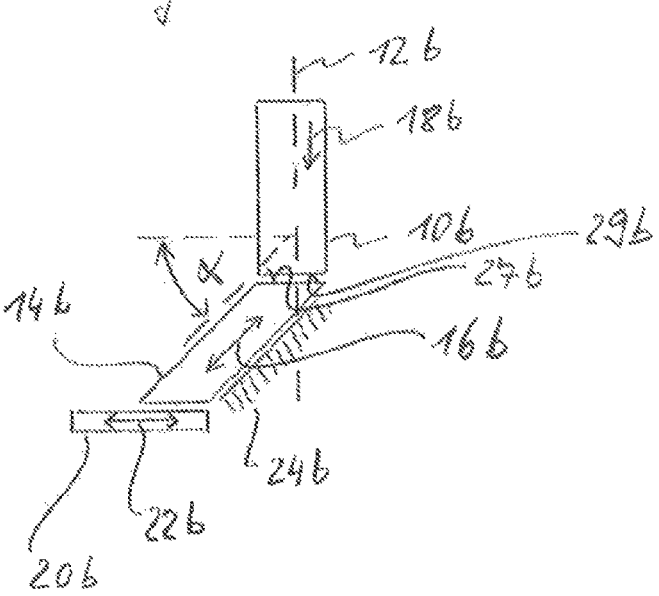

DOOR LATCH FOR AN ELECTRICAL HOUSEHOLD APPLIANCE, FOR EXAMPLE A WASHING MACHINE

BACKGROUND OF THE INVENTION

1. Field of the Invention

The present invention relates generally to a door latch for an electrical household appliance. Particularly, the present invention relates to a door latch for a laundry treatment appliance, for example a washing machine.

2. Description of the Prior Art

The door latch considered here is one of the so-called types with an indirect locking mechanism. Such a latch type has a gripping unit which serves to grip and retain a striker (or other closing body) as a door of the household appliance is closed and thereby hold the door closed. The gripping unit can be locked in a closed position by a plurality of mechanically series-connected arresting elements so that it cannot be opened. Each of the arresting elements can be displaced between two positions. A first arresting element can be moved into a position in which it effects a blocking of the gripping unit. After the first arresting element has moved into its position blocking the gripping unit, a second arresting element is in turn moved into a locking position in which it effects a blocking of the first arresting element so that this cannot move out if its blocking position. This corresponds to a closed and locked state of the door.

If the second arresting element is guided back out of its locking position into an unlocking position, the first arresting element is free again. This corresponds to a closed, but unlocked, state of the door. In this state, the gripping unit can drive the first blocking element out of its blocking position into a release position (typically in opposition to spring force) if the door is pulled in order to open it.

Typically, in the type of door latches considered here, an actuator is associated with the last arresting element in the chain of arresting elements and this can be used to move it between its locking position and its unlocking position.

For the prior art of such door latches with an indirect locking mechanism, please refer to WO 2011/132213 A1 and WO 2013/109585 A2.

According to WO 2011/132213 A1, a rotational body serving as a gripping unit is constructed with a so-called cavity into which a first arresting element dips as the door is closed. Inclined surfaces on the walls of the cavity and on the first arresting element ensure that a division of force takes place if an attempt is made to rip open the door when the door is closed and locked. Part of the force transmitted here from the gripping unit to the first arresting element is diverted directly into a housing of the latch by way of the first arresting element. Only a residual part of the force is transmitted from the first arresting element to a second arresting element which serves to selectively block the first arresting element.

According to WO 2013/109585 A2, a division of force does not take place between a gripping unit and a first arresting element, but between the first arresting element and an intermediate element which is seated in the force-transmission path between the gripping unit and the first arresting element. The intermediate element and the first arresting element are guided at a right-angle to one another, with a wedge-type engagement between both elements ensuring the desired division of force. If the door is pulled when it is closed and locked, the force acting on the gripping unit is transmitted via the intermediate element and from there into the first arresting element. The wedge-type engagement between the intermediate element and the first arresting element causes part of the force from the first arresting element to be diverted directly into a housing of the latch so that only a residual part of the force is transmitted further to a second arresting element serving to selectively block the first arresting element.

The solution according to WO 2011/132213 A1 is problematic in that the required cavity on the gripping unit is associated with a weakening of the material, which can have a disadvantageous effect on the load bearing capacity of the gripping unit.

SUMMARY OF THE INVENTION

The present invention moreover takes as its starting point a door latch for an electrical household appliance that includes a latch housing, a gripping unit which is received in the latch housing and is movable in a rotational plane between an open rotational position and a closed rotational position and which, in the closed rotational position, grips a striker for holding a door of the household appliance closed and, in the open rotational position, releases the striker for opening the door, a first arresting element which is received in the latch housing such that it is movable between a release position and an arresting position and which, in the arresting position, effects a blocking of the gripping unit to prevent rotation into the open rotational position and, in the release position, permits a rotation of the gripping unit into the open rotational position, where the first arresting element has an engagement surface which, in the arresting position, is opposite an engagement counter-surface of the gripping unit, where an engagement between the engagement surface of the first arresting element and the engagement counter-surface of the gripping unit generates a force component which acts parallel to the rotational plane of the gripping unit on the first arresting element, and a second arresting element which is received in the latch housing such that it is movable between an unlocking position and a locking position and which, in the locking position, effects a blocking of the first arresting element to prevent movement into the release position and, in the unlocking position, permits a movement of the first arresting element from the arresting position into the release position.

A door latch of this type is characterized according to the present invention by a guide arrangement which guides the first arresting element such that it is movable relative to the latch housing in a guide direction extending at an incline to the rotational plane of the gripping unit. This design enables a division of force between the first arresting element and the guide arrangement so that the second arresting element is protected from a load exerted by the full force which can occur in the closed and locked state of the door when the door is pulled. Part of this force can be diverted from the first arresting element via the guide arrangement; only a residual part is conducted further from the first arresting element to the second arresting element. The design according to the invention requires neither a cavity in the gripping unit nor an additional slide element to effect a division of force in conjunction with the first arresting element.

In one embodiment, the guide arrangement is constructed on the latch housing. For example, the latch housing can form a system of one or more guide walls on which the first arresting element is movably guided in the guide direction.

In one embodiment, the guide direction is linear. Instead of a linearly movable slide, the first arresting element can alternatively be constructed as a rotary slide. In this case, the guide direction extends along a curved path (e.g. a circular path).

With a linear course of the guide direction, this can extend at an angle between 20 and 50 degrees or an angle between 25 and 45 degrees or an angle between 30 and 40 degrees relative to a normal direction to the rotational plane of the gripping unit. The residual force which is transmitted to the second element when the closed and locked door is pulled can decrease as the angle increases. However, a larger angle can increase the force which a user wanting to open the closed but unlocked door has to apply to drive the first arresting element out of its blocking position. The concretely selected angle between the guide direction and the normal direction to the rotational plane of the gripping unit can therefore be the result of a compromise which, on the one hand, ensures that a user can open the door relatively easily—if it is unlocked—and, on the other hand, ensures that the second arresting element is not subjected to an excessive load if the closed and locked door is pulled.

In embodiments of the invention, upon an engagement between the engagement surface and the engagement counter-surface, a resultant force acting on the first arresting element is generated, which has a parallel direction of action to the rotational plane of the gripping unit. A division of force between the gripping unit and the first arresting element is thereby prevented. For example, the engagement surface and the engagement counter-surface can be constructed as planar surfaces with a surface plane which is in each case orthogonal to the rotational plane of the gripping unit.

The gripping unit can form a gripping jaw which is delimited by two cheeks and in which the striker is captured as the door is closed, with the striker impacting against a first cheek of the gripping jaw as the door is closed and thereby setting the gripping unit in rotation, and with the second cheek of the gripping jaw reaching behind the striker in the closed rotational position of the gripping unit. To prevent the gripping unit from breaking if the door is pulled with excessive force, without having to increase the material thickness of the gripping unit unnecessarily, the gripping unit can be metal-reinforced at least in a region of the second cheek. To this end, the gripping unit can have a base body made from a plastic material, which has a cutout equipped with a metal pin in the region of the second cheek. It is alternatively conceivable for the gripping unit to have a reinforcing plate body which is sheathed with a plastic material and extends from the second cheek into the region of the first cheek. The reinforcing plate body can be for example a punched sheet-metal part.

The object of the invention is furthermore a laundry treatment appliance which has a main appliance housing and a door which is mounted on the main appliance housing for the purpose of closing an access opening to a laundry treatment space of the appliance. According to the invention, such a laundry treatment appliance is equipped with a door latch of the type mentioned above. A possible laundry treatment appliance is, for example, a washing machine. An embodiment as a washer dryer is likewise feasible.

The invention is explained in more detail below with reference to the accompanying drawings.

BRIEF DESCRIPTION OF THE DRAWINGS

FIGS. 1 and 2 are schematic illustrations of components of two prior art door latches.

FIG. 3 is a schematic illustration of components of a door latch according to an inventive design.

DETAILED DESCRIPTION

Figure 4:
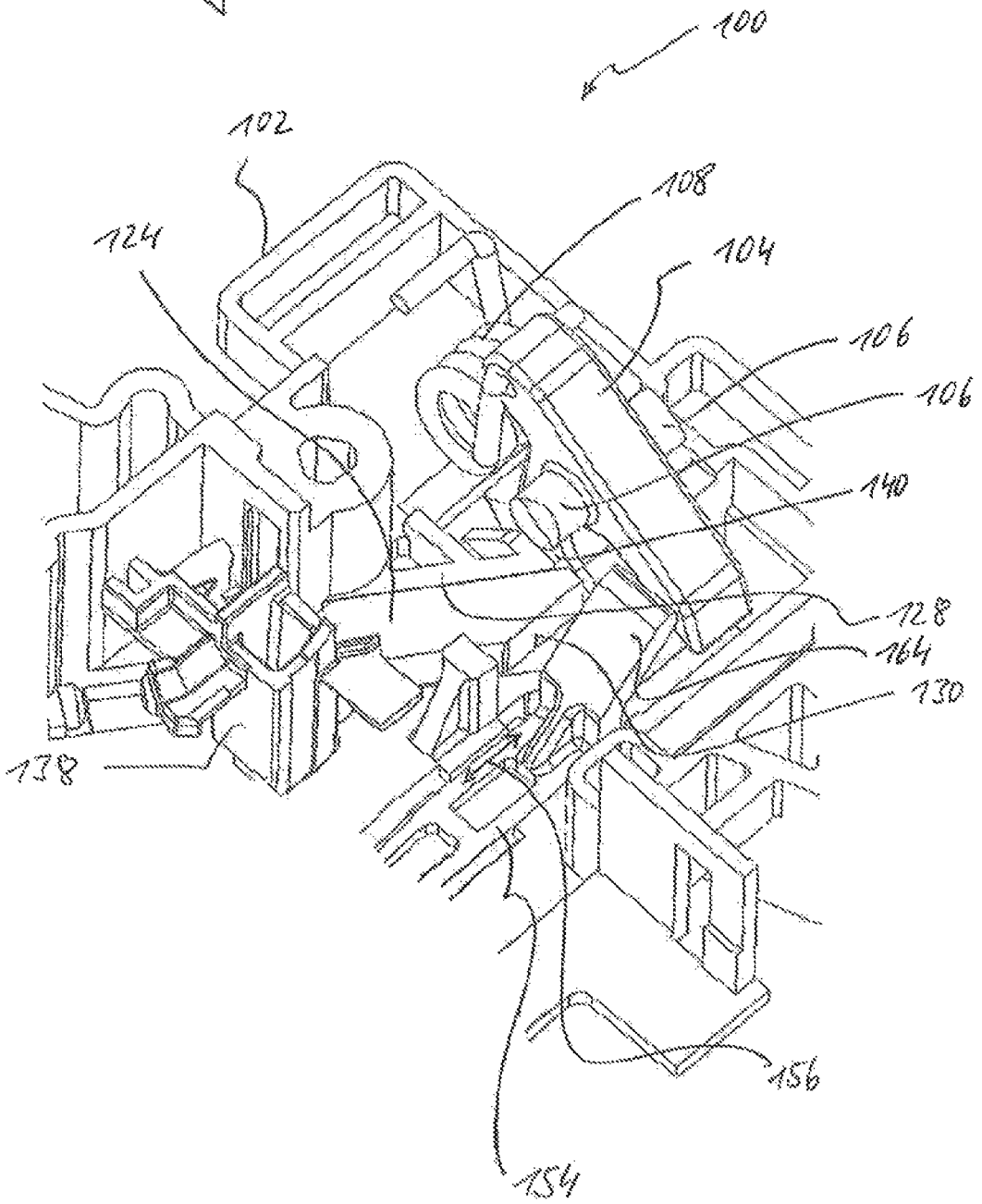
FIG. 4 is a perspective view of part of one embodiment of an inventive door latch in a state when the door is open.
Figure 5:
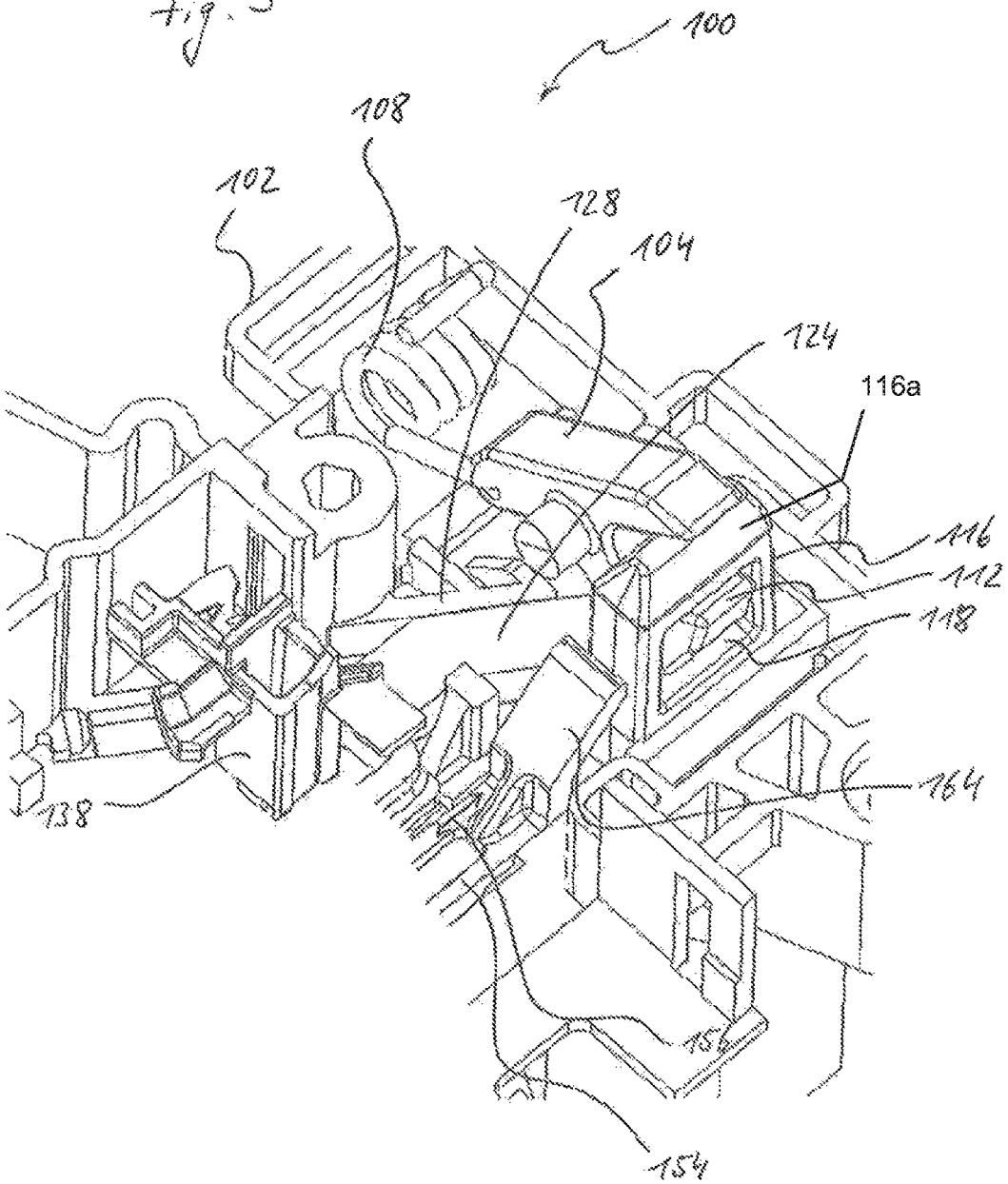
FIG. 5 is a perspective view of the embodiment according to FIG. 4 in a state when the door is closed.

Reference is first of all made to the prior art examples according to FIGS. 1 and 2. In FIG. 1, a gripping unit 10 is shown schematically, which is mounted such that it is rotatable in a rotational plane indicated by a dashed line 12 and, as the door of an electrical household appliance in which the door latch is integrated is closed, grips and retains a closing body (for example in the form of a striker) which is not illustrated in more detail. In the closed state of the door, a blocking slide 14 is in wedge-type engagement with the gripping unit 10. The blocking slide 14 is linearly movably guided in a normal (i.e. perpendicular) direction with respect to the rotational plane 12, as indicated by a double-headed arrow 16. If the door is pulled for the purpose of opening it, a force is transmitted to the gripping unit 10, which attempts to displace the gripping unit 10 along the rotational plane 12 in rotational and/or translatory manner (schematically indicated by an arrow 18). The wedge-type engagement between the gripping unit 10 and the blocking slide 14 results in the gripping unit 10 being able to drive the blocking slide 14 to the side (i.e. to the left in FIG. 1) and the door can therefore be opened.

It is possible to lock the closed door in that a locking element 20, which is for example linearly displaceably guided between an unlocking position and a locking position (indicated by a double-headed arrow 22), is moved in front of the blocking slide 14 in the closed state of the door in such a way that this blocking slide cannot draw back when the door is pulled. This situation is shown in FIG. 1. A force acting on the gripping unit 10 as a result of an attempt to open the door is then divided into two components as a result of the wedge-type engagement between the gripping unit 10 and the blocking slide 14. A first component acts along the movement direction of the blocking slide 14 (i.e. along the double-headed arrow 16) and is diverted to the locking element 20. Another force component acts parallel to the rotational plane 12 and is diverted by the blocking slide 14 directly into a housing (indicated schematically by 24) of the door latch. As a result of the division of force, therefore, the locking device 20 is not acted upon by the full force applied to the gripping unit 10 upon an attempt to open the door. Instead, only part of this force is diverted to the locking element 20.

In FIGS. 2 and 3, similar or similar-acting components to those in FIG. 1 are denoted by the same reference numerals, albeit supplemented by a lower-case letter. Unless stated otherwise below, please refer to the above embodiments relating to FIG. 1 for an explanation of these components.

In the prior art example according to FIG. 2, an additional intermediate slide 26*a* is provided, which is displaceably guided along the rotational plane 12*a* as indicated by a double-headed arrow 28*a*. Contrary to the prior art example according to FIG. 1, in the prior art example according to FIG. 2 there is a wedge-type engagement between the blocking slide 14*a* and the intermediate slide 26*a*. There is no direct engagement between the blocking slide 14*a* and the gripping unit 10*a*. Conversely, the gripping unit 10*a* is in engagement with the intermediate slide 26*a*, but in a form which does not generate a resultant force obliquely or perpendicularly to the rotational plane 12*a*. In the simplest case, the engagement between the gripping unit 10*a* and the intermediate slide 26*a* is configured as a blunt abutment. If the door is pulled when the door is closed and locked, this then leads to a diversion of force from the gripping unit 10*a* via the intermediate slide 26*a* to the blocking slide 14*a* and from there—owing to the wedge-type engagement between the blocking slide 14*a* and the intermediate slide 26*a*—partially to the locking element 20*a* and partially directly to the housing 24*a*.

In the inventive embodiment according to FIG. 3, only the blocking slide 14*b* is located in the force transmission path between the gripping unit 10*b* and the locking element 20*b*. An additional slide, such as the intermediate slide 26*a* of the prior art example according to FIG. 2, for instance, is not essentially ruled out, but it is not a requirement. The engagement between the gripping unit 10*b* and the blocking slide 14*b* is configured so that, when the door is pulled, a resultant force acts parallel to the rotational plane 12*b* on the blocking slide 14*b*. To this end, the blocking slide 14*b* can have, for example, a planar engagement surface 27*b* which is located orthogonally to the rotational plane 12*b* and is obtusely opposite a likewise planar engagement counter-surface 29*b* of the gripping unit 10*b*.

Contrary to the two prior art examples according to FIG. 1 and FIG. 2, the blocking slide 14*b* in the embodiment according to FIG. 3 is movably guided on the housing 24*b* in a direction which is at an incline to the rotational plane 12*b*. The angle of inclination can be expressed in terms of a normal to the rotational plane 12*b* and is denoted by the Greek letter $\alpha$ in FIG. 3. In embodiments of the invention, it can be between 30 and 40 degrees, for example approximately 35 degrees.

If an attempt is made to open the door when the door is closed but not locked, the gripping unit 10*b* can drive the blocking slide 14*b* aside owing to its inclined guidance on the housing 24*b* and the door can therefore be opened. However, this cannot happen if the blocking slide 14*b* is blocked by the locking element 20*b*. The force introduced from the gripping unit 10*b* into the blocking slide 14*b* is then divided into two force components as a result of the inclined guidance on the housing 24*b*. One of these force components is diverted from the blocking slide 14*b* directly into the housing 24*b*, the other force component is transmitted to the locking element 20*b*. The amount of force introduced into the locking element 20*b* can be influenced by the size of the angle $\alpha$.

The blocking slide 14*b* forms a first arresting element according to the invention, the locking element 20*b* forms a second arresting element according to the invention.

Figure 6:
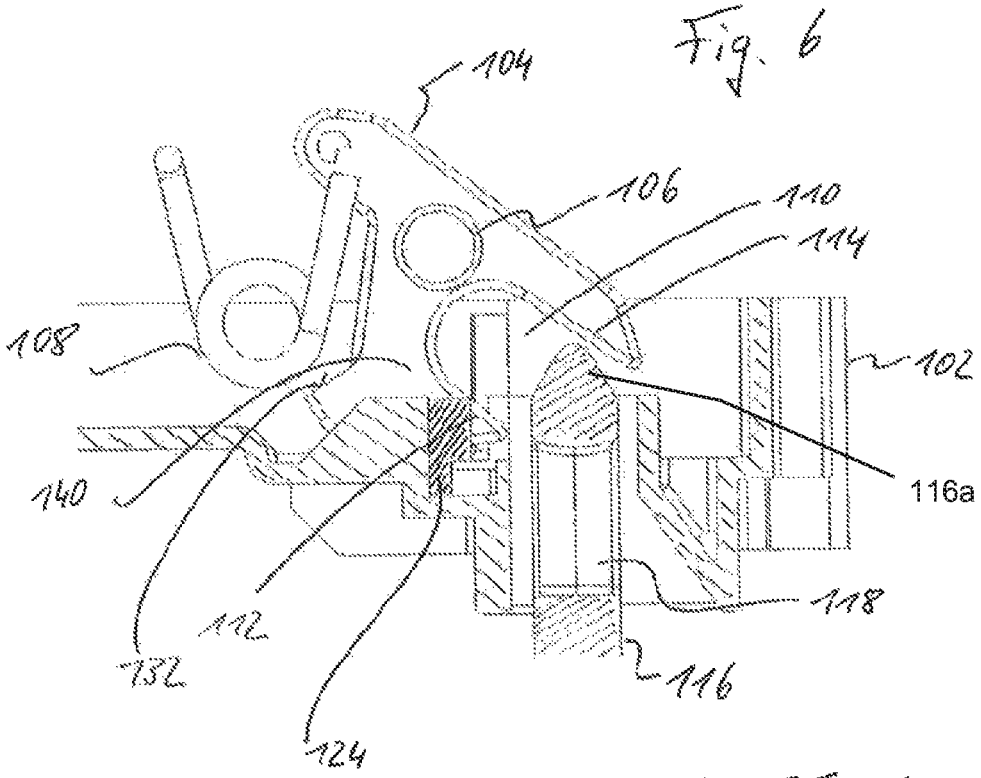
FIG. 6 is a section through the door latch according to the embodiment of FIGS. 4 and 5 when the door is open.
Figure 7:
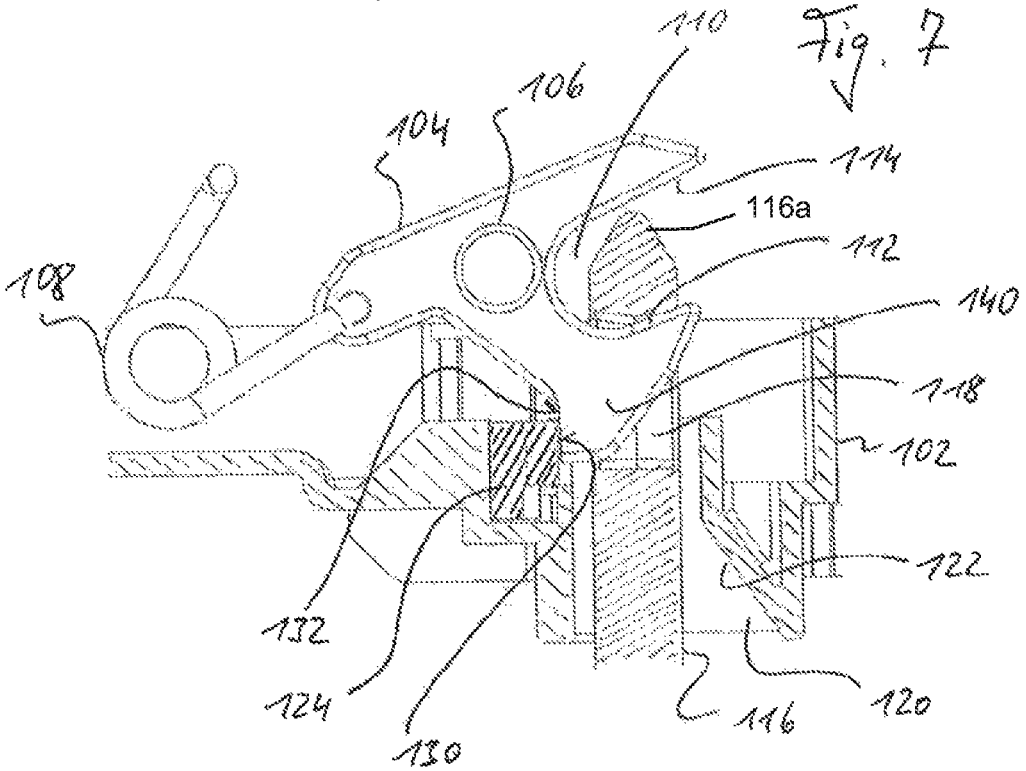
FIG. 7 is a section through the door latch according to the embodiment of FIGS. 4 and 5 when the door is closed.

Reference is now made to the concrete embodiment according to FIGS. 4 to 8. The door latch illustrated in these Figures is denoted in general by 100. It has a latch housing 102 which is typically made of plastic material and in which a gripping unit 104 is received such that it is displaceable between an open rotational position and a closed rotational position. The gripping unit 104 corresponds for example to the gripping unit 10*b* according to FIG. 3 and, in FIGS. 4 and 6, is shown in its open rotational position whereas, in FIGS. 5 and 7, it is shown in its closed rotational position. The gripping unit 104 has two guide projections 106 which protrude on both sides and by means of which it is guided in a manner not shown in more detail. The gripping unit 104 is pre-tensioned in bi-stable manner both in its open rotational position and its closed rotational position by means of a leg spring 108. Upon a transition of the gripping unit 104 from one of its rotational positions into the other, the leg spring 108 is firstly placed under greater tension until a point of maximum tension is reached (snap point), beyond which the gripping unit 104 snaps into the respective other rotational position.

The gripping unit 104 forms a gripping jaw 110, which is delimited by two cheeks 112, 114. As the door of the household appliance is closed, a striker 116 dips into the closing jaw 110 with a leading end region 116*a* and abuts against the closing or first cheek 114. This sets the gripping unit 104 in rotation (shown counter-clockwise in FIG. 6) and effects a shift of the gripping unit 104 from the open rotational position into the closed rotational position. In the course of this procedure, the other or second cheek 112 moves into a cutout 118 in the striker 116 and thereby retains this latter. A lead-in jaw 120 with a funnel-type lead-in chamfer 122 is formed on the latch housing 102. As the door of the household appliance is closed, the striker 116, which is mounted for example on the door, dips into this lead-in jaw 120.

Figure 8:
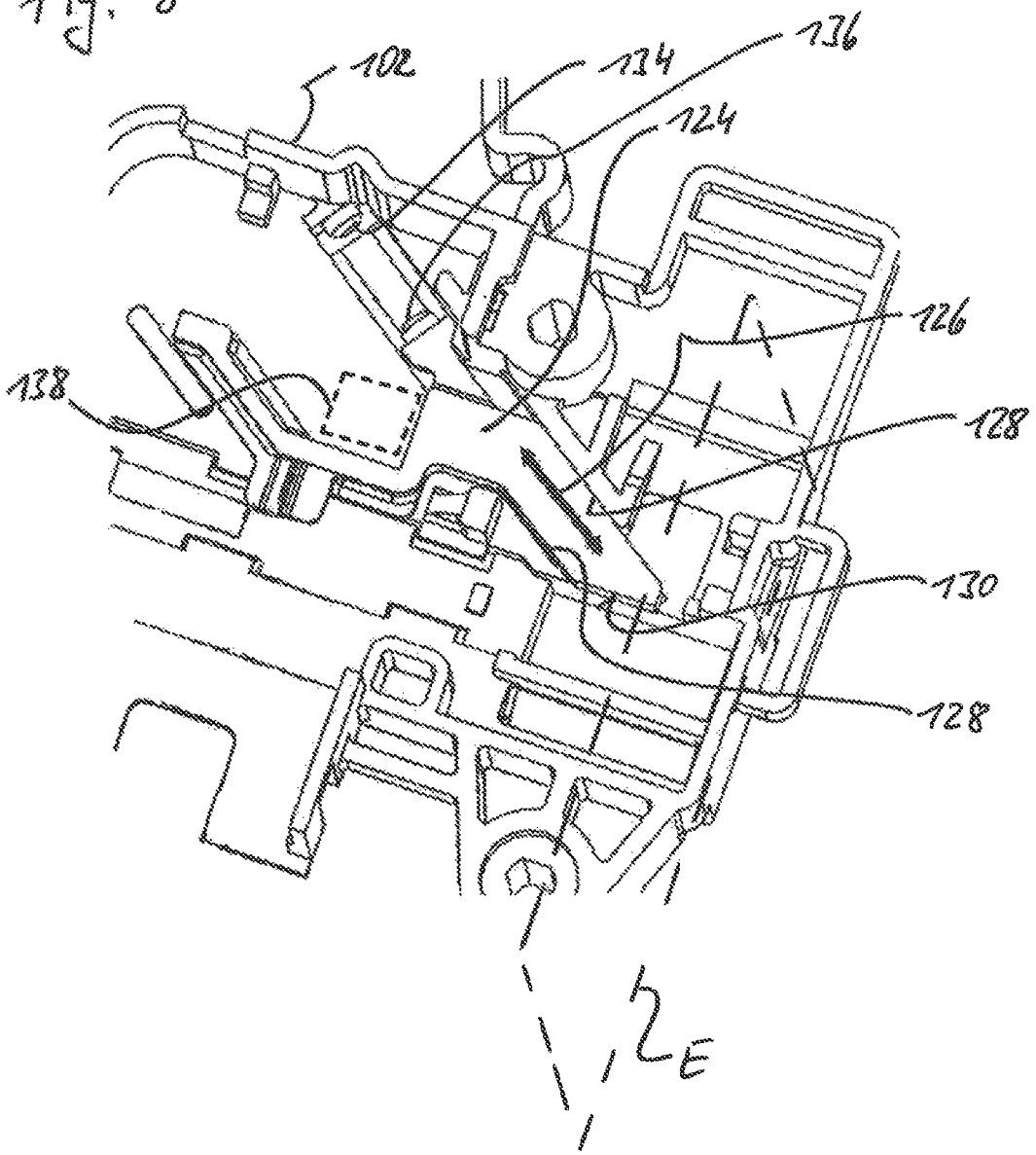
FIG. 8 is a perspective view of a latch housing of the door latch according to the embodiment of FIGS. 4 and 5 with a blocking slide which is movably guided in the housing.

In the closed rotational position, the gripping unit 104 can be blocked by a blocking slide 124. The blocking slide 124 corresponds for example to the blocking slide 14*b* according to FIG. 3. It is displaceably guided on the latch housing 102, relative to this latter, in a direction indicated by a double-headed arrow 126 (FIG. 8). To guide the blocking slide 124, the latch housing 102 has guide walls 128 which together form a guide arrangement according to the invention. For example these guide walls 128 can be formed by side walls of a guide channel which is formed in the latch housing 102 and in which the blocking slide 124 is inserted. The blocking slide 124 is pre-tensioned by a pre-tensioning spring (not illustrated in more detail) in the direction of the position according to FIG. 8. This position corresponds to an arresting position in which an engagement surface 130 formed on the blocking slide 124 is moved in front of an engagement counter-surface 132 formed on the gripping unit 104 and thereby blocks the gripping unit 104 to prevent rotation into the open rotational position. This situation is clearly shown in FIG. 7; in FIG. 8, the gripping unit 104 is not shown for the sake of clarity. The said pre-tensioning spring of the blocking slide 124 is inserted between a housing-side supporting point 134 and a supporting point 136 formed on the blocking slide 124 and is formed for example by a helical compression spring.

In its arresting position, the blocking slide 124 can be blocked by a locking element 138 (indicated by a dashed line in FIG. 8) to prevent it from moving out of the arresting position. The locking element 138 corresponds for example to the locking element 20*b* according to FIG. 3. It can be moved between an unlocking position and a locking position in a manner not illustrated in more detail by means of an actuating device (which comprises for example an electromagnetic actuator). In the unlocking position, it releases the blocking slide 124 so that this can be driven out of the arresting position, in opposition to the pre-tensioning force acting on the blocking slide 124, in the direction of a release position. In the locking position, on the other hand, the locking element 138 prevents this type of movement of the blocking slide 124.

When the door is open, the blocking slide 124 abuts under pre-tension against a side cheek 140 of the gripping unit 104. If the gripping unit 104 is rotated out of its open rotational position into the closed rotational position, the blocking slide 124 slips along the side cheek 140 until an anti-slip edge formed at the transition between the side cheek 140 and the engagement counter-surface 132 moves past the blocking slide 124. At this moment, the blocking slide 124 snaps into its arresting position, upon which the engagement surface 130 arrives in front of the engagement counter-surface 132. This corresponds to the closed state of the door.

In order to open the door, a user has to pull on it forcefully enough to enable the gripping unit 104 to drive the blocking slide 124 out of the arresting position into the release position in opposition to the force of the pre-tensioning spring of the blocking slide 124. As is clearly shown in FIG. 8, the guide direction of the blocking slide 124, which is indicated by the double-headed arrow 126, is orientated at an incline to a rotational plane E (indicated by a dashed line) of the gripping unit 104. With regard to the effect of this inclined orientation and possible angular values, please refer to the embodiments referring to the angle $\alpha$ in conjunction with the explanation of FIG. 3. At this point, it suffices to say that the inclined guidance of the blocking slide 124 (inclined with respect to the rotational plane E) enables the gripping unit 104 to drive the blocking slide 124 out of the locking position into the release position. As soon as the blocking slide 124 has moved sufficiently far in the direction of the release position, the side cheek 140 of the gripping unit 104 arrives back in front of the blocking slide 124 and prevents this from returning into the arresting position.

Further accommodated in the latch housing 102 is an auxiliary slide 154 which is linearly displaceable along a displacement direction indicated by a double-headed arrow 156. The auxiliary slide 154 serves to actuate an electrical door switch (not illustrated in more detail) whereof the switch status (open or closed) can be detected by an electrical control unit (likewise not illustrated in more detail) to determine whether the door of the household appliance is open or closed.

In the situation according to FIG. 4, the auxiliary slide 154 is located in a first control position in which the auxiliary slide 154 abuts with a lug 164 against the side cheek 140 of the gripping unit 104. This corresponds for example to an open switch status of the door switch. A pre-tensioning spring, constructed for example as a helical compression spring, pre-tensions the auxiliary slide 154 in this position. In the situation according to FIG. 5 (i.e. when the door is closed), the auxiliary slide 154 is located in a second control position in which the auxiliary slide 154 is driven by the striker 116 when this latter abuts against the lug 164 upon the door being closed and pushes the lug away sideways. The second control position of the auxiliary slide 154 corresponds for example to a closed switch status of the door switch.

Figure 9:
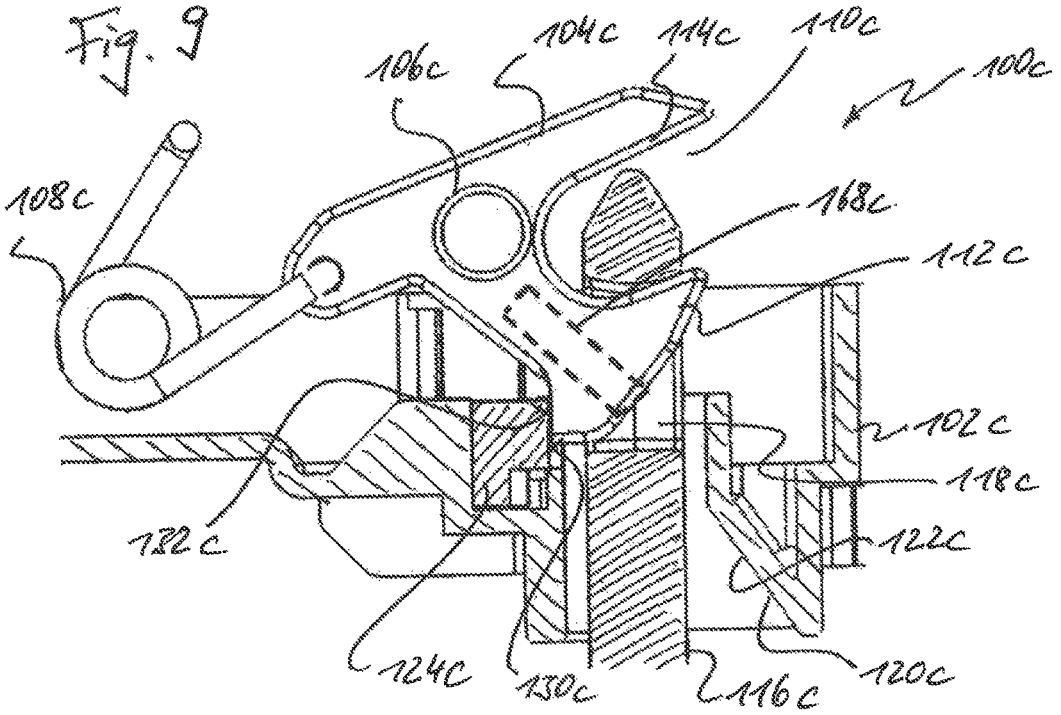
FIGS. 9 and 10 are two variants of a metal-reinforced design of a gripping unit for the door latch according to the embodiment of FIGS. 4 and 5.
Figure 10:
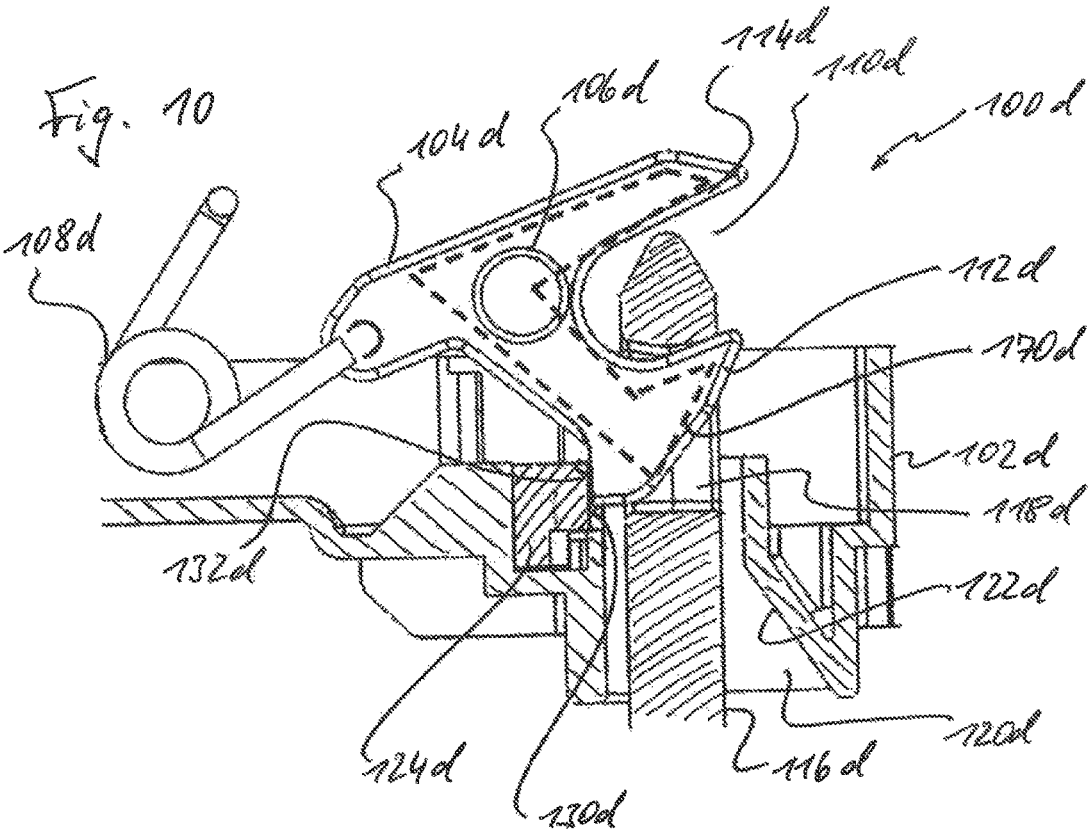

Reference is now made to FIGS. 9 and 10. In these, similar or similar-acting components to those in FIGS. 4 to 8 are provided with the same reference numerals, albeit supplemented by a lower-case letter c or d. For an explanation of such components, please refer to the above embodiments within the framework of the embodiment of FIGS. 4 to 8.

In the variant according to FIG. 9, the gripping unit 104*c* is formed by a plastic body, which is manufactured for example by injection moulding and is constructed, in the region of the cheek 112*c*, with an elongated blind hole in which a metal reinforcing pin 168*c* (indicated by a dashed line) is inserted. The reinforcing pin 168*c* crosses a potential break line along which the cheek 112*c* can break off from the rest of the gripping unit 104*c* when a closed and locked door is pulled with excessive force. In the illustration of FIG. 9, the striker 116*c* in this case presses from above against the cheek 112*c*. If the gripping unit 104*c* is not reinforced, the moment acting on the cheek 112*c* here can sometimes be great enough for the cheek 112*c* to sever. An analysis of the tensions which occur can be used to readily predict the location of the break line. The blind hole for the reinforcing pin 168*c* is formed in the plastic base body of the gripping unit 104*c* for example in such a way that the reinforcing pin 168*c* crosses the anticipated break line at an approximate right angle (in relation to the pin axis).

In the variant according to FIG. 10, a reinforcing plate body 170*d* can be provided instead of a single reinforcing pin to reinforce the gripping unit 104, which reinforcing plate body extends continuously from the one cheek 112*d* to the other cheek 114*d*, and therefore over the anticipated break line, and is embedded in a plastic material. The embedding is effected for example by sheathing the reinforcing plate body 170*d* with the plastic material. The reinforcing plate body 170*d* is for example a punched-out sheet metal part.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A door latch for an electrical household appliance, the door latch comprising:

a latch housing;

a gripping unit; which is received in the latch housing and is rotatable in a rotational plane between an open rotational position and a closed rotational position, wherein the gripping unit, in the closed rotational position, grips a striker for holding a door of the household appliance closed and, in the open rotational position, releases the striker for opening the door;

a first arresting element, which is received in the latch housing such that it is guided for movement relative to the latch housing in a guide direction between a release position and an arresting position, wherein the first arresting element, when it is in the arresting position, effects a blocking of the gripping unit to prevent rotation of the gripping unit into the open rotational position, and when the first arresting element is in the release position, it permits a rotation of the gripping unit into the open rotational position, wherein the first arresting element has an engagement surface, wherein when the first arresting element is in the arresting position, the engagement surface faces an engagement counter-surface of the gripping unit, wherein an engagement between the engagement surface of the first arresting element and the engagement counter-surface of the gripping unit is effective to introduce into the first arresting element a force in a direction parallel to the rotational plane of the gripping unit; and a second arresting element, which is received in the latch housing such that it is movable between an unlocking position and a locking position, wherein the second arresting element, when it is in the locking position, effects a blocking of the first arresting element to prevent movement of the first arresting element into the release position and, when the second arresting element is in the unlocking position, it permits a movement of the first arresting element from the arresting position into the release position wherein the guide direction extends at an incline to the rotational plane of the gripping unit.

2. A door latch according to claim 1, wherein the first arresting element is guided on the latch housing.

3. A door latch according to claim 1, wherein the guide direction is linear.

4. A door latch according to claim 3, wherein the guide direction extends at an angle between 20 and 50 degrees or an angle between 25 and 45 degrees or an angle between 30 and 40 degrees relative to a normal direction to the rotational plane of the gripping unit.

5. A door latch according to claim 1, wherein the engagement surface and the engagement counter-surface are formed as planar surfaces, each with a surface plane which is orthogonal to the rotational plane of the gripping unit.

6. A door latch according to claim 1, wherein the gripping unit forms a gripping jaw which is delimited by two cheeks and in which the striker is captured when the door is closed, wherein the striker strikes against a first cheek of the gripping jaw as the door is closed and thereby sets the gripping unit in rotation, and wherein the second check of the gripping jaw reaches behind the striker in the closed rotational position of the gripping unit, wherein the gripping unit is metal-reinforced at least in a region of the second cheek.

7. A door latch according to claim 6, wherein the gripping unit has a base body made from a plastic material, which has a cutout fitted with a metal pin in the region of the second cheek.

8. A door latch according to claim 6, wherein the gripping unit has a reinforcing plate body which is sheathed with a plastic material and extends from the second cheek into the region of the first cheek.

9. A laundry treatment appliance having a door latch, the treatment appliance comprising:

a main appliance housing defining a laundry treatment space accessible through an access opening;

a door mounted on the main appliance housing for selectively opening and closing the access opening; and a door latch comprising:

a latch housing;

a gripping unit, which is received in the latch housing and is rotatable in a rotational plane between an open rotational position and a closed rotational position, wherein the gripping unit, in the closed rotational position, grips a striker for holding the door closed and, in the open rotational position, releases the striker for opening the door;

a first arresting element, which is received in the latch housing such that it is guided for movement relative to the latch housing in a guide direction between a release position and an arresting position, wherein the first arresting element, when it is in the arresting position, effects a blocking of the gripping unit to prevent rotation of the gripping unit into the open rotational position, and when the first arresting element is in the release position, it permits a rotation of the gripping unit into the open rotational position, wherein the first arresting element has an engagement surface, wherein when the first arresting element is in the arresting position, the engagement surface faces an engagement counter-surface of the gripping unit, wherein an engagement between the engagement surface of the first arresting element and the engagement counter-surface of the gripping unit is effective to introduce into the first arresting element a force in a direction parallel to the rotational plane of the gripping unit;

a second arresting element, which is received in the latch housing such that it is movable between an unlocking position and a locking position, wherein the second arresting element, when it is in the locking position, effects a blocking of the first arresting element to prevent movement of the first arresting element into the release position and, when the second arresting element is in the unlocking position, it permits a movement of the first arresting element from the arresting position into the release position, wherein the guide direction extends at an incline to the rotational plane of the gripping unit.

10. A door latch for an electrical household appliance, the door latch comprising:

a latch housing;

a gripping unit, which is received in the latch housing and is rotatable in a rotational plane between an open rotational position and a closed rotational position, wherein the gripping unit, when the gripping unit is in the closed rotational position, grips a striker for holding a door of the household appliance closed and, when the gripping unit is in the open rotational position, the gripping unit releases the striker for opening the door;

a first arresting element, which is received in the latch housing such that it is guided for movement relative to the latch housing in a guide direction between a release position and an arresting position, wherein the first arresting element, when it is in the arresting position, effects a blocking of the gripping unit to prevent rotation of the gripping unit into the open rotational position, and when the first arresting element is in the release position, it permits a rotation of the gripping unit into the open rotational position, wherein the first arresting element has an engagement surface, wherein when the first arresting element is in the arresting position, the engagement surface faces an engagement counter-surface of the gripping unit, wherein an engagement between the engagement surface of the first arresting element and the engagement counter-surface of the gripping unit is effective to introduce into the first arresting element a force in a direction parallel to the rotational plane of the gripping unit; and a second arresting element, which is received in the latch housing such that it is movable between an unlocking position and a locking position, wherein the second arresting element, when it is in the locking position, effects a blocking of the first arresting element to prevent movement of the first arresting element into the release position and, when the second arresting element is in the unlocking position, it permits a movement of the first arresting element from the arresting position into the release position, wherein the gripping unit forms a gripping jaw which is delimited by two cheeks and in which the striker is captured when the door is closed, wherein the striker strikes against a first cheek of the gripping jaw as the door is closed and thereby sets the gripping unit in rotation, and wherein the second cheek of the gripping jaw reaches behind the striker in the closed rotational position of the gripping unit, wherein the gripping unit comprises a plastic material which is metal-reinforced at least in a region of the second cheek.

11. A door latch according to claim 10, wherein the gripping unit has a base body made from the plastic material, the base body having a cutout fitted with a metal pin in the region of the second cheek.

12. A door latch according to claim 10, wherein the gripping unit has a reinforcing plate body which is sheathed with the plastic material and extends from the second cheek into the region of the first cheek.

* * * * *